United States Patent [19]

Babjak et al.

[11] Patent Number: 4,764,353

[45] Date of Patent: Aug. 16, 1988

[54] LEACHING OF URANIUM ORE

[75] Inventors: Juraj Babjak; Eberhard Krause, both of Mississauga, Canada

[73] Assignee: Inco Limited, Canada

[21] Appl. No.: 380,075

[22] Filed: May 20, 1982

[51] Int. Cl.[4] ..... C01G 43/01

[52] U.S. Cl. ..... 423/20; 423/18

[58] Field of Search ..... 423/18, 20

[56] References Cited

U.S. PATENT DOCUMENTS

| | | | |
|---|---|---|---|
| 2,736,634 | 2/1956 | Gaudin et al. | 423/18 |
| 2,841,467 | 7/1958 | McCullough | 423/18 X |
| 2,925,321 | 2/1960 | Mariacher | 423/20 |
| 3,092,447 | 6/1963 | Legge et al. | 423/18 |
| 3,159,452 | 12/1964 | Lerner | 423/18 |

OTHER PUBLICATIONS

Merritt, Robert C., The Extractive Metallurgy of Uranium, Colorado School of Mines Research Institute, 1971, pp. 63–71, 82.

*Primary Examiner*—Matthew A. Thexton

*Attorney, Agent, or Firm*—Raymond J. Kenny; Francis J. Mulligan, Jr.

[57] ABSTRACT

Uranium is leached from water slurries of uranium ore by incorporating a mixture of sulfur dioxide and air therein to provide the oxidizing and acidifying requirements to accomplish leaching.

8 Claims, No Drawings

LEACHING OF URANIUM ORE

The present invention is directed to a method for leaching uranium from its ores and more particularly to a method which can be conducted in remote geographic areas with minimum importation of reagents.

BACKGROUND OF INVENTION AND THE PRIOR ART

It is known that uranium occurs principally in oxide form in its various ores. Furthermore, uranium usually occurs in relatively lean ores averaging, for example, approximately 0.3% uranium content. Uranium ores are for the most part not amenable to concentration by conventional means. Accordingly, the ore as extracted from the ground is simply crushed, ground and leached to yield a uranium containing solution and a barren rock waste which is rejected.

Processes which have been used for leaching uranium involve either acidic or basic leaching means. The common means employed in treating most North American lean uranium ores involves leaching with sulfuric acid along with an oxidizing agent which may be, for example, manganese dioxide, oxygen or sodium chlorate. In order for leaching with sulfuric acid to be successful, the ore being treated must also contain iron. If the ore contains insufficient iron, iron may be added, as metallic iron. Ferric iron plays an important role in the oxidation of tetravalent uranium. It may be considered that the acid leaching of uranium from ores containing uranium in the +IV oxidation state proceeds according to two steps:

$$UO_2+4H^+\rightarrow U^{4+}+2H_2O$$

$$U^{4+}+2Fe^{3+}+2H_2O\rightarrow UO_2^{2+}+2Fe^{2+}+4H^+$$

These reactions proceed simultaneously and the overall reaction can be given as:

$$UO_2+2Fe^{3+}\rightarrow UO_2^{2+}+2Fe^{2+}$$

Conventionally, oxidants such as sodium chlorate or manganese dioxide are used to oxidize ferrous iron to ferric iron. The ratio of ferric to ferrous ions in the solution determines the oxidation potential thereof.

Although no mention of uranium is present therein it is known from U.S. Pat. No. 2,816,819 that iron in a solution which also contains nickel or cobalt can be oxidized from the ferrous to the ferric state by introduction of a mixture of sulfur dioxide and air thereinto.

Again, it is known from U.S. Pat. No. 3,869,360 that sea nodules can be treated with sulfur dioxide in the presence of oxygen to form the water soluble sulfates of manganese, nickel, copper and cobalt. It is considered in this patent, however, that sulfur dioxide acts as a reducing agent with respect to the metal value content of the sea nodules and it is stated therein that soluble iron sulfate formed is converted to the insoluble oxide.

In the Panel Proceedings Series, *Uranium Ore Processing* of the International Atomic Energy Agency, Vienna, 1976 p. 32 under the heading "Ferric Leaching and Autoxidation of Recycled Solutions", it is stated that a process wherein air and sulfur dioxide were blown into solutions containing ferrous sulfate to form sulfuric acid and ferric sulfate was studied during the early stages of the development of the acid leaching process for uranium extraction from Witwatersrand cyanide residues.

An article entitled "Leaching of High-Solids, Attritor-Ground Chalcopyrite Concentrate by in situ Generated Ferric Sulfate Solution" in *Metallurgical Transactions B* Vol 11B, March 1980, describes leaching of copper from chalcopyrite pulps containing up to 20% solids using a mixture of oxygen and sulfur dioxide introduced into the pulps to oxidize ferrous ion to ferric ion for leaching copper from the sulfide.

It is known that once the uranium values of an ore are dissolved as sulfate, uranium can be recovered by ion exchange or solvent extraction.

SUMMARY OF THE INVENTION

A slurry of particulate uranium ore in water is contacted with a mixture of sulfur dioxide and air to leach the uranium content of the ore therefrom.

DETAILED DESCRIPTION OF THE INVENTION

The uranium ore to be treated may be comminuted, for example, such that about 90% thereof will pass a 65 mesh screen, although fineness of grind is not particularly critical and coarser grinds may be used. Ore slurries containing 5% to about 80% solids, by weight, e.g., 50% solids, may be treated in accordance with the invention. The sulfur dioxide/air mixture comprising the primary reagent may contain sulfur dioxide in the range of about 0.02% or about 0.05% to about 5%, or even about 10%, by volume. It is to be understood that the sulfur dioxide/air mixture is the only reagent needed in accordance with the invention, since most uranium ores contain sufficient iron to carry out the necessary reactions and the sulfur dioxide/air mixture forms sulfuric acid in the solution as well as acting as an oxidizing agent to oxidize ferrous iron to ferric iron. Auxiliary acidification with sulfuric acid may be employed. Redox potential and pH can both be utilized to determine when leaching has proceeded sufficiently for essentially complete removal of uranium from the ore. Essentially complete removal of uranium occurs when the pH of the solution is at least as acid as pH 2, for example, pH 1.5, by which time the redox potential of the solution as measured in relation to the calomel electrode will rise to at least about 350 millivolts, e.g. at least about 400 millivolts. Contact between the sulfur dioxide/air mixture and the water slurry may be accomplished simply by bubbling the gaseous mixture into the liquid, as, for example, is accomplished in a standard flotation machine. Agitation in the area of gas introduction is necessary. One or more pachuca reactors may be employed. So agitation becomes more effective, proportionally greater amounts of sulfur dioxide may be mixed. Reaction temperatures may vary widely between the freezing and boiling points of the slurry at ambient pressure. Leaching may also be performed at superatmospheric pressures, but additional equipment and operating costs result.

The following example will now be given. 400 grams of uranium ore containing 2.75% $U_3O_8$ was ground such at 99% passed the 65 mesh screen. The ground ore was placed in a reaction kettle provided with a propellor-type agitator and water was added to form a slurry containing 50% solids, by weight. The pump was heated to 50° C. and a mixture of air and sulfur dioxide containing 1.5% by volume of sulfur dioxide was introduced below the eye of the agitator at a flowrate of 0.51 liters per minute for a total of 23 h. Leaching was then continued with 0.75% $SO_2$ containing air for an additional 6 h. During leaching the pH of this slurry fell to 0.9 and the redox potential measured against the calomel electrode rose to +460 mV. After 29 h of leaching the slurry was filtered and both the leach residue and the leach solution were analyzed for uranium. 98.2% uranium had been dissolved and the residue contained only 0.057% $U_3O_8$. The leach solution was estimated to contain 6.84 grams per liter of uranium.

In contrast to the foregoing example, it was found that when a slurry of the same ore in the same concentration of 50% solids was leached with sulfuric acid in the amount of 50 kilograms acid per ton of ore for a total of 24 h at 50° C., the final pH was 1.4 and the redox potential was +260 mV against the calomel electrode. 92.1% uranium was extracted and the leached residue contained 0.23% $U_3O_8$.

When another portion of the same ground ore slurry was leached with addition of sulfuric acid in the amount of 90 kilograms per ton of ore along with 8 kilograms of sodium chlorate per ton of ore for a total of 24 h at 50° C., a final pH of 0.8 and a redox potential of +520 mV against the calomel electrode were reached. 98.2% of the uranium was extracted and the leached residue contained 0.055% $U_3O_8$.

Leaching with an addition of 50 kilograms sulfuric acid per ton of ore and 5 kilograms of sodium chlorate per ton for 24 h at 50° C., yielded a leach residue analyzing 0.067% $U_3O_8$ with a uranium extraction of 97.7%. The final pH was 1.2 and the redox potential was +440 mV against the calomel electrode. Yet another portion of the same slurry of ground ore was subjected to leaching with sulfur dioxide only. The conditions were as in the example but no air was added. After 24 h at 50° C. the resulting residue analyzed 1.48% $U_3O_8$ with an extraction of only 53.1% uranium. The final pH was 2.1 and the redox potential was +175 millivolts.

The foregoing demonstrates that during leaching with $SO_2$ and air, the components necessary to solubilize uranium from the ore, namely, acid and oxidant are supplied.

The present invention is of particular value in treating uranium ores at remote locations. Thus, the only reagent which needs to be transported to the site is elemental sulfur, which can be burned to sulfur dioxide and mixed with air for purposes of the invention. The economic advantage of transporting elemental sulfur which is a dry substantially inert material as compared to transporting sulfuric acid to a remote site are immediately apparent. Similarly, the invention is described in terms of mixtures of sulfur dioxide and air, although oxygen enrichment would probably be beneficial. The higher amounts of $SO_2$ may be employed with oxygen enrichment. Provision of oxygen at a remote site would be expensive. While the term "mixture" has been employed hereinbefore in relation to $SO_2$-air, it is to be understood that $SO_2$ and air can be separately introduced.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A process for treating uranium ores containing uranium in oxide form and iron to solubilize uranium therein as $UO_2$ ++ and recover uranium therefrom which comprises slurrying particulate uranium ore containing uranium in oxide form in water, treating said slurry with sulfur dioxide and air at a ratio of about 9 to 1 to 5000 to 1 air to sulfur dioxide until a final pH at least as acid as pH2 is reached to leach the uranium from said ore particles and thereafter separating the uranium-containing solution from the essentially barren solids.

2. The process according to claim 1 wherein iron is added to the slurry.

3. A process according to claim 1 wherein the sulfur dioxide and air is employed in a ratio of about 19 to 1 to about 2000 to 1.

4. The process according to claim 1 wherein the ore slurry contains about 5% to about 80% solids.

5. The process according to claim 1 wherein said slurry contains about 50% solids, by weight, and said sulfur dioxide and air are in a ratio of about 66 to 1.

6. The process according to claim 1 wherein leaching is conducted to a pH at least as acid as pH 1.5.

7. The process according to claim 5 wherein leaching is conducted to a pH of about 1.5.

8. The process according to claim 1 wherein leaching is conducted to a redox potential at least as high as 350 millivolts.

* * * * *